United States Patent [19]

Ross

[11] 4,417,224

[45] Nov. 22, 1983

[54] TIME DELAY FUSE

[75] Inventor: Michael E. Ross, Schaumburg, Ill.

[73] Assignee: Federal Pacific Electric Co., Newark, N.J.

[21] Appl. No.: 331,248

[22] Filed: Dec. 16, 1981

[51] Int. Cl.[3] ..... H01H 85/04

[52] U.S. Cl. ..... 337/164; 337/293; 337/295

[58] Field of Search ..... 337/163, 164, 165, 166, 337/290, 292, 293, 295, 296

[56] References Cited

U.S. PATENT DOCUMENTS

| | | | |
|---|---|---|---|
| 713,831 | 11/1902 | Badeau | 337/292 |
| 2,018,556 | 10/1935 | Hope | 337/295 X |
| 2,800,554 | 7/1957 | Dannenberg et al. | 337/296 X |
| 3,123,693 | 3/1964 | Kozacka | 337/164 |
| 3,735,312 | 5/1973 | Nagel | 337/164 |
| 4,058,784 | 11/1977 | Gaia | 337/164 |

FOREIGN PATENT DOCUMENTS

| | | | |
|---|---|---|---|
| 439517 | 12/1935 | United Kingdom | 337/296 |

*Primary Examiner*—George Harris

*Attorney, Agent, or Firm*—Ronald R. Stanley

[57] ABSTRACT

A time delay fuse is disclosed which does not require stored energy devices or separated chamber construction, and is dependent on the mass of the low melting point material and metal connector blocks to absorb heat on short duration overloads. The time delay fuse includes one or more fusible links having a combination of relatively high melting point material and a relatively low melting point mass enabling short circuit protection at a multiple of rated current and sustained overload protection at values above rated current. The number of fuse links used in the fuse is directly related to the intended current rating for the total fuse but may be from one to at least 15 links.

11 Claims, 5 Drawing Figures

TIME DELAY FUSE

BACKGROUND OF THE INVENTION

The present invention relates to time delay fuses for use in electrical power distribution circuits. The fuse of the present invention is both dependable and inexpensive to construct as a result of the unique fuse construction.

Time delay fuses are often constructed such that when opening under an overload condition, a stored energy arrangement causes a portion of the fuse element to move out of the current path. This movement from the current path may result from either a spring mechanism biasing the fuse element portion or gravitational forces. In either case, isolation of the particular fuse element is required such that the commonly used arc extinguishing filler material does not contact or surround the stored energy portion of the fuse link. Examples of this type of time delay fuse are illustrated by U.S. Pat. Nos. 2,159,423; 2,577,531; 2,644,872; 2,688,676 and 3,418,614. Of these patents, only the first two rely upon a spring means for moving the fuse element out of the current path. The balance of the patents rely upon gravitational force on the heat absorbing mass opening the circuit. The common requirement throughout these patents is the necessity to isolate the heat absorbing mass from the portion of the fuse containing the arc extinguishing filler material. Clearly, the effort necessary for isolation results in added effort and expense in construction of the fuse.

The inclusion of an arc extinguishing material within the fuse enclosure is required due to the current rating of the particular type of time delay fuse being considered in each instance. Without such an arc extinguishing material, the opening of the fuse element within the enclosure at the expected current ranges could cause destruction of portions of the fuse encasement with resultant damage to the power distribution equipment. As noted above, it has been found to be desirable to isolate the low melting point mass for long time overcurrent protection from the balance of the fuse enclosure such that the arc extinguishing material is not in contact with the low melting point mass. U.S. Pat. No. 2,018,556 illustrates one attempt at constructing a fuse which does not require isolation of the low melting point mass from the arc extinguishing material. As explicitly stated in this reference, the fuse may be damaged and thus rendered inoperable if the low melting point material is raised to a temperature high enough to run without breaking the circuit. This reference found it necessary to provide a clearing agent of boric acid to thus accelerate open circuiting of the fuse in the event of a sufficient rise in temperature in the low melting point material.

U.S. Pat. No. 2,800,554 discloses a fuse having multiple link elements within a cartridge filled with arc extinguishing material. The purpose of the fuse in this instance is not necessarily to obtain time delay, but rather, to have the low melting point material located within one fuse link accelerate opening of the balance of the fuse elements due to the current through each increasing when the low melting point fuse element opens.

SUMMARY OF THE INVENTION

The present invention is related to a particular class of fuses designed to operate with a minimum of $I^2t$ and peak let-through current under fault conditions. Heretofore, a time delay fuse was unavailable in this class in which the disclosed fuse is intended to be used due to the extremely fast operating time and extremely low $I^2t$.

As a result of the disclosed design, a stored energy device is not necessary to clear the circuit and, therefore, the need for isolation of the low melting point mass and separate filling operations for the arc extinguishing filler material are eliminated. The low melting point mass is able to absorb enough heat for the fuse to obtain 500% rated current for the required 10 seconds. Upon exceeding rated current by a given percentage for a sustained period of time, the low melting point mass attains a liquid state and flows toward the nearest hot spot at which point amalgamation occurs as well known in the art. Even when used in a vertical orientation, the fuse of the present disclosure enables proper opening of the circuit despite the relatively fast flowing of the low melting point mass exposing the junction of the two high temperature fuse elements before amalgamation occurs.

These and other objects of the present invention will become fully understandable from the following description of preferred forms of the invention, with reference to the accompanying drawings.

DETAILED DESCRIPTION OF THE PREFERRED EMBODIMENTS

Figure 1:
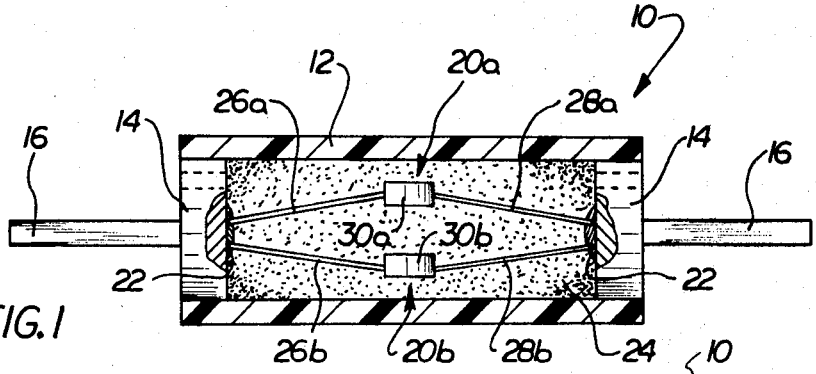
FIG. 1 is a longitudinal, mid-sectional view of a fuse made in accordance with the present invention.
Figure 2:
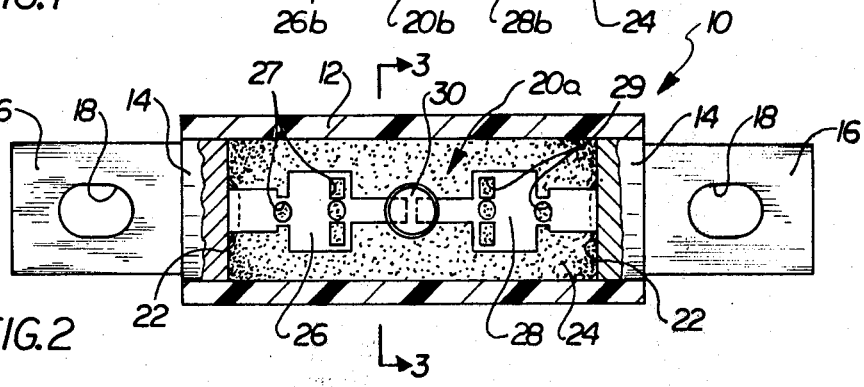
FIG. 2 is a cross-sectional view of the fuse shown in FIG. 1 taken along line 2—2 further illustrating the present invention.
Figure 3:
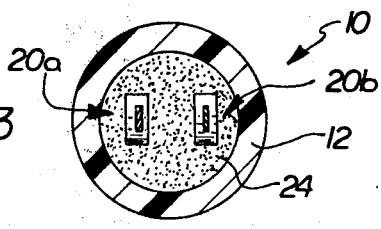
FIG. 3 is a cross-sectional view taken along line 3—3 of FIG. 2 illustrating the fuse of the present invention.

A fuse constructed in accordance with the present invention is intended to have an extremely low $I^2t$ and peak let-through current while being an extremely fast operating fuse. In addition, the ability to provide time delay results in a unique and extremely useful fuse. FIG. 1 illustrates a fuse 10 constructed in accordance with the present invention. Relatively conventional elements are used in the basic construction of fuse 10, including a cartridge 12 made of a well known material such as glass-melamine or glazed ceramic material and metal connector blocks 14 closing the tubular ends of cartridge 12. Connector plates 16 preferably integral with the connector blocks are used to connect the fuse into an electrical circuit. Connector plate 16 includes at least one aperture 18 extending therethrough as is conventional in the art. Cartridge 12 and connector blocks 14 together comprise an enclosed area which, while not providing an airtight seal, confines the internal components of fuse 10.

The physical dimensions of cartridge 12 and connector blocks 14 as well as the number of fusible components provided within the confines of fuse 10 are determined by the current range at which fuse 10 is intended to be used. Fuse 10 is intended for use over a wide variety of current ranges. The fuse shown in FIG. 1 illustrates two fusible links 20*a* and 20*b*. The fusible links are arranged to electrically connect connector blocks 14 at either end of cartridge 12. Each end of each link is therefore soldered to the respective connector block as indicated at 22. The entire enclosed area of cartridge 12 and connector blocks 14 is filled with an arc extinguishing material 24 as is well known in the art.

Figure 4:
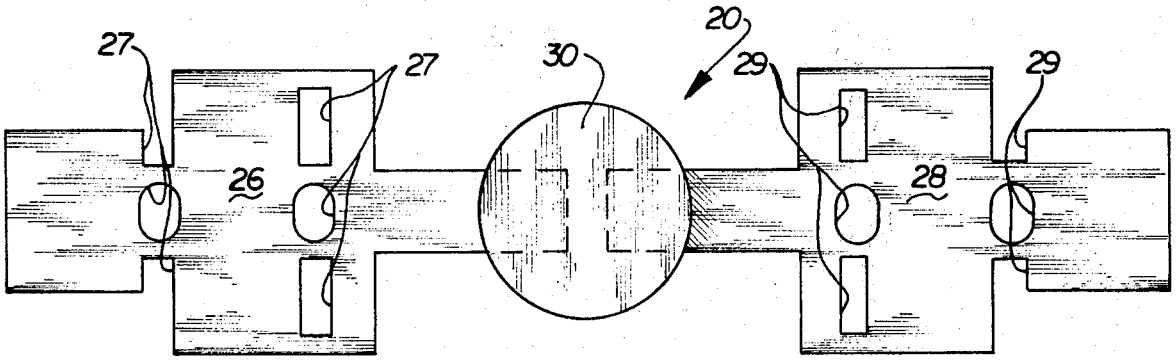
FIG. 4 is a plan view of a fuse link as used in the fuses shown in FIGS. 1 and 2 incorporating the principles of the present invention.

The fuse of the present invention provides time delay without the necessity of stored energy to clear the circuit. This benefit is accomplished by providing fusible links 20 in a three-part construction as illustrated in FIG. 4. Fusible link 20 includes a pair of spaced, relatively high melting point, fusible conductors 26 and 28. One end of each of fusible conductors 26 and 28 is united by a low melting point mass 30 located between the conductors. Low melting point mass 30 is preferably constructed of a cast eutectic alloy and may be made in accordance with the principles taught in U.S. Pat. No. 3,688,676, assigned to the common assignee hereof. Since conductors 26 and 28 are spaced apart, as noted above, the two are connected only by low melting point mass 30.

Conductors 26 and 28 are constructed in accordance with well known methods in fuse construction to have a higher melting point than mass 30. To obtain this higher melting point, the conductors may be constructed of materials such as commercial brass, bronze or silver or other electrically conductive materials, in a ribbon-like configuration which will fuse upon the passage therethrough of a sufficiently high current. Further in accordance with well known manufacturing criteria for fuses, conductors 26 and 28 are provided with multiple restricted portions 27 and 29, respectively, along the length thereof as evident by the multiple of notches and/or apertures spaced along the lengths thereof. The intention, of course, is to require that the conductors fuse open starting at the center of the conductor and moving toward the edges thereof. Conductors 26 and 28 are symmetric in design such that low melting point mass 30 is located precisely in the middle of fusible link 20.

The fusible links are located within cartridge 12 and secured at either edge thereof to conductor blocks 14, as noted above. The spacing of fusible links 20 relative to one another and the inside surface of cartridge 12 is, of course, dependent upon the number of links used for the particular fuse rating. It is important that the fusible links not contact one another nor the inside surface of cartridge 12 when mounted within the cartridge. Once fusible links 20 have been securely mounted within cartridge 12, the confines of the cartridge and connector blocks 14 are filled with arc extinguishing material 24, as noted above. The arc extinguishing material is in immediate contact with all surfaces of fusible links 20 and operates to quench any arc which should form by the fusing of fusible conductors 26 and 28 during operation of fuse 10 under short circuit or overload interruption conditions.

Fusible conductors 26 and 28 act as heaters to cause low melting point mass 30 to melt if fuse 10 is subjected to overload current for a predetermined length of time. The relatively large mass of low melting point material serves as a heat sink such that overloads of short duration will not heat the mass to the melting point and thus avoid nuisance fusing.

As the low melting point mass melts, amalgamation of fusible conductors 26 and 28 results in the molten mass being drawn along the surfaces of the fusible conductors in accordance with the "M effect" (Metcalf) principle, as well known in the art. With continued heating of the low melting point mass, the space between fusible conductors 26 and 28 begins to become unobstructed by the low melting point mass while amalgamation tends to cause fusing of fusible conductors 26 and 28 at the restricted areas thereon.

Figure 5:
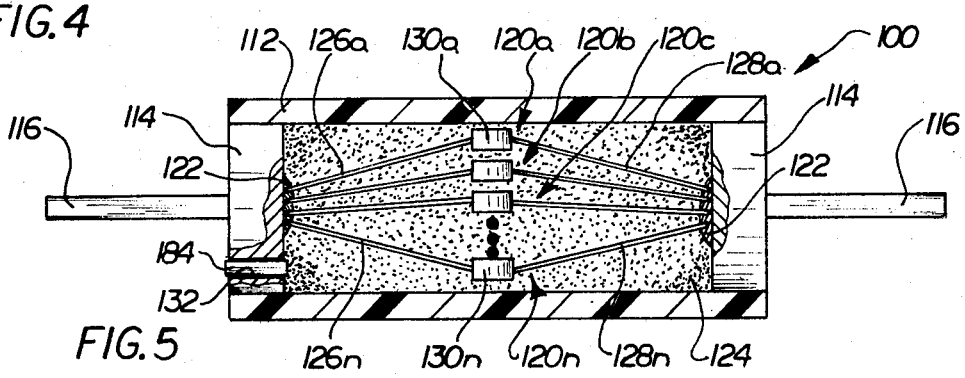
FIG. 5 is a longitudinal, mid-sectional view of an alternate embodiment of a fuse constructed in accordance with the present invention.

In accordance with the principles of the present invention, the number of fusible links provided within the fuse is related to the current rating intended for the fuse. FIG. 5 illustrates a fuse 100 constructed much like fuse 10 shown in FIGS. 1 through 4, but including a plurality of fusible links. Fuse 100 includes a cartridge 112 having connector blocks 114 closing the ends thereof with connector plates 116 attached thereto for connection of the fuse into an electrical circuit. A plurality of fusible links 120*a* through 120*n* are connected between connector blocks 114 in the same manner as noted above. Each fusible link, 120*a* through 120*n*, includes spaced, relatively high melting point, fusible conductors 126 and 128 and a low melting point mass 130 connecting the inner ends of the spaced fusible conductors. While the plurality of fuse links are shown, in FIG. 5, as being parallel and adjacent one another, the links are preferably spaced from one another and cartridge 112. Once the fusible links have been connected between connector blocks 114, the confines of cartridge 112 and the connector blocks are filled with arc extinguishing material 124, as through an opening 132 in block 114 which is thereafter sealed by a plug 184.

In the case of a multiple fuse link time delay fuse, the current to be conducted by the fuse is divided equally among the multiple fuse links. Since the current travelling through each of the multiple fusible links is identical, all of the fusible links should fuse simultaneously upon the application of a short circuit and likewise the low melting point masses should liquefy approximately at the same time upon the occurrence of a sustained overload. The invention contemplates fuses having from 1 to at least 15 fuse links incorporated therein.

In the event that fuse 10 or 110 is mounted in a vertical fashion, such that low melting point mass 30 or 130 might flow fast enough to expose the junction between the two fusible conductors 26,28 or 126,128, an arc occurring in the opening will burn back the fusible conductor until the distance between the conductors, in conjunction with the dielectric formed by the arc extinguishing filler material, creates an impedance too great to sustain further arcing within the fuse.

What is claimed is:

1. A fuse for providing short circuit and time delay overcurrent protection comprising: an insulating cartridge having a tubular shape with first and second ends, a pair of connector blocks each being sealingly attached at said first and second ends of said cartridge, two or more fusible links electrically connected between said pair of connector blocks, said fuse links including first and second portions constructed of relatively high melting point electrically conductive material, said first and second portions being spaced apart with one end of each connected to one of said connector blocks, a third portion constructed of a relatively low melting point electrically conductive material, said third portion joining said first and second portions at the other ends of each, and a quantity of arc extinguishing material within said cartridge and surrounding said fusible link.

2. The fuse according to claim 1 wherein said first and second portions of said fuse links are formed of a relatively thin ribbon of the high melting point material and include at least one area of reduced cross-section for current control.

3. The fuse according to claim 2 wherein said first and second portions are spaced symmetrically within said cartridge and said third portion is located at the middle of said cartridge.

4. The fuse according to claim 2 wherein said first and second portions are constructed of one or combinations of more than one electrically conductive material.

5. The fuse according to claim 3 wherein said third portion is constructed of an eutectic alloy cast in place to connect said first and second portions, whereby the mass of said third portion absorbs heat energy, and prevents opening of the fuse unless an electric overload is sustained.

6. The fuse according to claim 1 wherein said arc extinguishing material contacts said third portion of said fuse links.

7. The fuse according to claim 1 wherein said fusible links is a plurality of from two to 15 fusible links.

8. A time delay fuse providing short circuit and overcurrent protection, comprising: a tubular cartridge with first and second ends, electrical connectors sealingly enclosing said first and second ends of said cartridge, a plurality of more than one fusible link electrically connected between said electrical connectors, said fusible links including first and second spaced portions constructed of relatively high melting point metal, said first and second portions connected to said electrical connectors, a third portion of said fusible links constructed of a relatively low melting point mass, said third portion centrally located relative to said first and second portions and electrically connecting said first and second portions, and a quantity of arc extinguishing material within said cartridge contacting said fusible links.

9. The time delay fuse according to claim 8 wherein said electrical connectors include terminal means for connection of said fuse into an electrical distribution network.

10. The time delay fuse according to claim 8 wherein said plurality of fusible links includes from two to 15 fusible links.

11. The time delay fuse according to claim 10 wherein said quantity of arc extinguishing materials is in contact with said first, second and third portions of each of said plurality of fusible links.

* * * * *